US007143731B2

(12) United States Patent
Kirbach et al.

(10) Patent No.: US 7,143,731 B2
(45) Date of Patent: Dec. 5, 2006

(54) CUP TAPPET OF A VALVE TRAIN OF AN INTERNAL COMBUSTION ENGINE

(75) Inventors: Lutz Kirbach, Hirschaid (DE); Robert Kamm, Veitsbronn (DE); Arndt Lhlemann, Hochstadt (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 11/126,469

(22) Filed: May 11, 2005

(65) Prior Publication Data

US 2005/0263119 A1 Dec. 1, 2005

(30) Foreign Application Priority Data

May 25, 2004 (DE) ..... 10 2004 025 532

(51) Int. Cl.
*F01L 1/14* (2006.01)

(52) U.S. Cl. ..... 123/90.48; 123/90.5; 123/90.44

(58) Field of Classification Search ..... 123/90.48, 123/90.5, 90.39, 90.44, 90.6; 74/567, 569
See application file for complete search history.

(56) References Cited

U.S. PATENT DOCUMENTS 5,904,123 A * 5/1999 Ammon et al. ..... 123/90.51

FOREIGN PATENT DOCUMENTS

| | | |
|---|---|---|
| DE | 691 03 613 T2 | 12/1994 |
| JP | 62045911 A | 2/1987 |
| JP | 06221118 A | 8/1994 |

* cited by examiner

*Primary Examiner*—Ching Chang
(74) *Attorney, Agent, or Firm*—Charles A. Muserlian

(57) ABSTRACT

The invention proposes a cup tappet (1) of a valve train of an internal combustion engine, said cup tappet (1) comprising a hollow cylindrical skirt (3) closed at one end by a bottom (2), said bottom (2) comprising an outer end surface (4) and an inner end surface (6), said outer end surface (4) comprising a contact surface (5) for a cam and said inner end surface (6) comprising a central support (7) for a gas exchange valve, wherein the inner end surface (6) of the bottom (2) comprises a radially extending flat web (8), the support (7) is arranged symmetrically between edges (9, 19) of the web (8), a leg (11, 12) sloping away from the bottom (2) after the manner of a roof extends from each edge (9, 10) up to an inner surface (13) of the skirt (3), and the legs (11, 12) are situated axisymmetrically opposite each other. This cup tappet (1) thus possesses a particularly good rigidity.

14 Claims, 1 Drawing Sheet

CUP TAPPET OF A VALVE TRAIN OF AN INTERNAL COMBUSTION ENGINE

FIELD OF THE INVENTION

The invention concerns a cup tappet of a valve train of an internal combustion engine, said cup tappet comprising a hollow cylindrical skirt closed at one end by a bottom, said bottom comprising an outer end surface and an inner end surface, said outer end surface comprising a contact surface for a cam and said inner end surface comprising a central support for a gas exchange valve.

BACKGROUND OF THE INVENTION

A generic cup tappet of the pre-cited type is known from JP 6-17609 (A). Apart from the support for the gas exchange valve, the inner and the outer end surfaces of the bottom of this cup tappet have more or less the same flat shape. Due to this shape, the bottom must have a relatively solid configuration, so that the cup tappet is able to support the dynamic loads and other similar loads occurring during its operation.

It must also be noted that this cup tappet must have a relatively large diameter in order to guarantee a sufficiently large excursion surface for the cam on the outer end surface.

OBJECTS OF THE INVENTION

It is an object of the invention to provide a cup tappet of the pre-cited type in which the aforesaid drawbacks are eliminated with simple measures.

This and other objects and advantages of the invention will become obvious from the following detailed description.

SUMMARY OF THE INVENTION

The invention achieves the above objects by the fact that the inner end surface of the bottom comprises a radially extending flat web, the support is arranged symmetrically between edges of the web, a roof-like sloping leg extends from each edge away from the bottom up to an inner surface of the skirt, and said legs are situated axisymmetrically opposite each other.

In this way, the initially cited drawbacks are eliminated with simple measures. Due to the roof-like sloping legs on the inner end surface of the bottom and the flatly extending web, a significant increase in the rigidity of the cup tappet is achieved, as also confirmed by FEM calculations. This enables an overall reduction of the mass of the cup tappet that, in turn, has an advantageous effect on the oscillating masses of the valve train.

According to a particularly advantageous proposition of the invention, the tappet comprises an anti-rotation means while, at the same time, the bottom, as viewed in excursion direction of the cam, has a cylindrical shape.

Due to the cylindrical shape with a guaranteed excursion surface for the cam on the outer end surface of the bottom, the diameter of the cup tappet can be reduced. According to a further proposition of the invention, the anti-rotation means is, for instance, a needle roller that is arranged in the skirt of the cup-tappet to project radially outwards beyond the skirt, so that in an installed state of the cup tappet, this needle roller extends in a longitudinal groove of a reception bore in the cylinder head or in a similar surrounding structure. If necessary, the cup-tappet may also have a self-centering configuration.

A further contribution to increasing rigidity is made, according to a further feature of the invention, if the web extends orthogonally to the cylindrical shape of the outer end surface of the bottom. If necessary, however, this web may also be arranged parallel to or generally only angularly offset to the cylindrical shape of the outer end surface of the bottom.

It is further proposed to configure the support for the gas exchange valve on the web as a frustoconical or reniform elevation. In this way, on the one hand, a defined support surface is created that, if necessary, may also have special wear-protection features. On the other hand, the support can be kept in readiness in variable heights for assembly at the engine manufacturer's.

In place of the reniform or frustoconical elevation on the web, a person skilled in the art will also consider further designs in the present context, such as purely cylindrical shapes etc.

As an alternative to the aforesaid elevation, the invention also includes a support in the form of a dish-like or similar cavity in the web.

It is particularly advantageous if the support, or the support together with the entire inner end surface of the bottom, is made by a fabrication method not involving chip removal such as, for example, stamping, stamping plus extrusion, forging or other similar methods.

The roof-like sloping legs can certainly be made of "solid material" as viewed in the direction of the bottom, but it is also conceivable and intended to make them as thin-walled ribs spaced from the inner end surface of the bottom. With this measure, if required, a further contribution is made to obtaining a light-weight structure and a reduction of the oscillating valve train masses.

Finally, further propositions of the invention concern special shapes of the roof-like sloping legs. These can be made, for example, with a convex or concave shape, or be substantially flat. In this connection, a person skilled in the art will use calculation and designing methods with which he is familiar to determine the shape of the legs that is suitable for his particular case of use.

Although the scope of protection of the invention extends particularly to cup tappets with mechanical lash adjustment, it is also possible, through a special adaptation, to design the cup tappet for hydraulic operation.

The invention will now be described more closely with reference to the appended drawing.

DETAILED DESCRIPTION OF THE DRAWING

Figure 1:
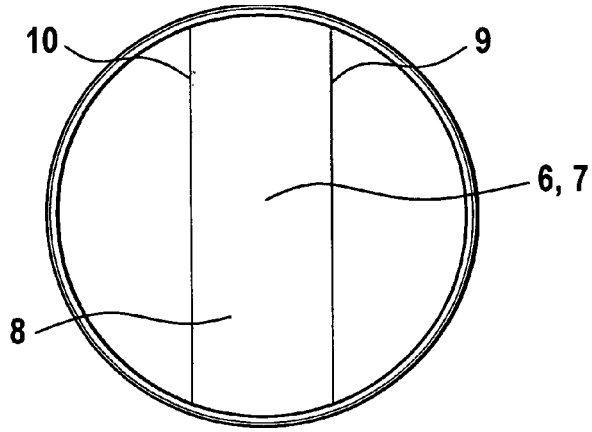
FIG. 1 is a bottom view of a cup tappet of the invention.

The figures disclose a cup tappet 1 of a valve train of an internal combustion engine. The cup tappet 1 comprises a hollow cylindrical skirt 3 that is closed at one end by a bottom 2. The bottom 2 comprises an outer end surface 4 that is configured as a contact surface 5 for a cam, not shown. As viewed in excursion direction A of the cam, the contact surface 5 has a cylindrical shape. As disclosed in FIG. 4, to assure a permanent alignment of the cup tappet 1 to the cam, the skirt 3 comprises a recess 14. An anti-rotation means 13*a*, only roughly illustrated, extends in this recess 14. The anti-rotation means 13*a* may be, for instance, a needle roller that is pressed into the recess 14 and projects slightly beyond the skirt 3 in radial direction, so that, after installation of the cup tappet 1 in its reception in the cylinder head, this needle roller extends in a longitudinal groove provided thereon.

Figure 2:
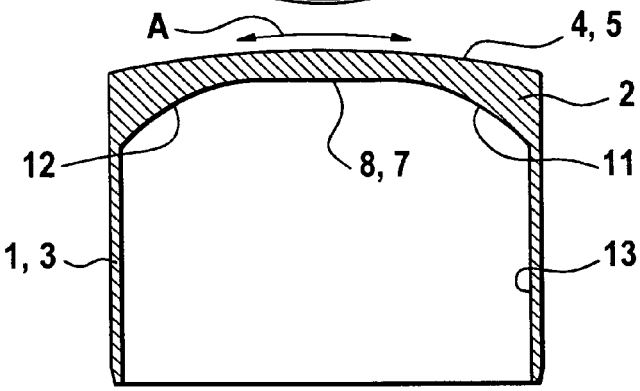
FIG. 2 shows a longitudinal section through the cup tappet of FIG. 1.
Figure 3:
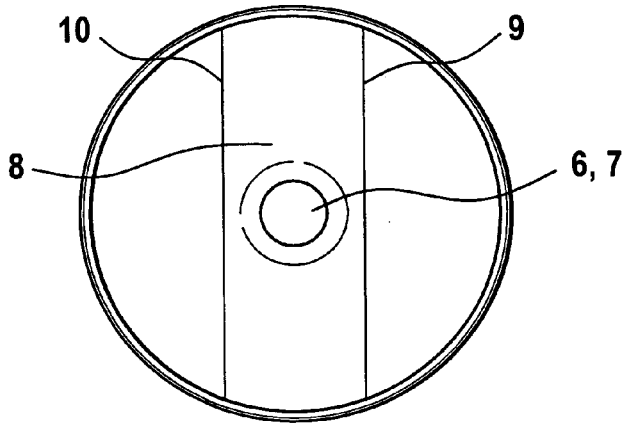
FIG. 3 is a bottom view of a further cup tappet of the invention.
Figure 4:
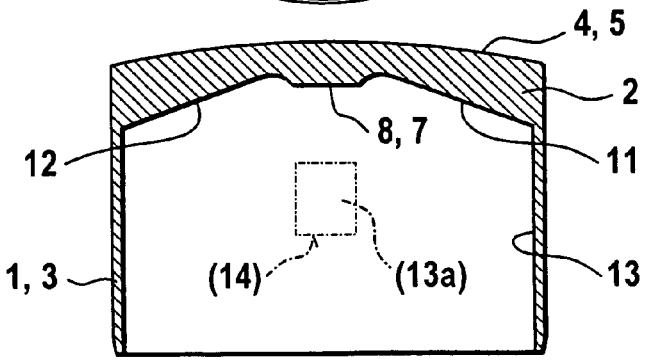
FIG. 4 shows a longitudinal section through the cup tappet of FIG. 3.

As can best be seen in FIGS. 2 and 4, the shape of an inner end surface 6 of the bottom 2 is distinctly different from that of the outer end surface 4. A radially extending flat web 8 is arranged on the inner end surface 6. At the center of the web 8 but, advantageously, at a distance from the edges 9, 10 of the web 8, is arranged a support 7 for a gas exchange valve. As best seen in FIGS. 3 and 4, this support 7 may be configured, for example, as a frustoconical elevation on the web 8. It must also be mentioned that the support 7 is advantageously generated in a fabricating method not involving chip removal, for example, stamping.

As a person skilled in the art will further see in the figures, a leg 11, 12 sloping away from the bottom 2 after the manner of a roof extends from each of the aforesaid edges 9, 10 to an inner surface 13 of the skirt 3. As shown in FIG. 2, the legs 11, 12 may have a slightly concave shape. But it is also possible, as disclosed in FIG. 4, for the legs 11, 12 to have a flat roof shape.

According to a particularly advantageous proposition of the invention, the entire inner end surface 6 of the bottom 2 is made together with the web 8 in one or more work steps by a non-cutting manufacturing method such as stamping or extrusion or the like. If necessary, however, a machining method may also be considered.

Due to the radially extending web 8 on the inner end surface 6 of the bottom 2 in conjunction with the roof-like sloping legs 11, 12, the cup tappet 1 of the invention has an increased rigidity. Its weight can thus be reduced. The person skilled in the art will repeat this designing process as often as necessary till he has found the optimum for a light-weight structure.

As an alternative, the legs 11, 12 may also extend from the edges 9, 10 in the direction of the skirt 3 toward the bottom 2.

The invention claimed is:

1. A cup tappet of a valve train of an internal combustion engine, said cup tappet comprising a hollow cylindrical skirt closed at one end by a bottom, said bottom comprising an outer end surface and an inner end surface, said outer end surface comprising a contact surface for a cam and said inner end surface comprising a central support for a gas exchange valve, wherein the inner end surface of the bottom comprises a radially extending flat web, the support is arranged symmetrically between edges of the web, a roof-like sloping leg extends from each edge away from the bottom up to an inner surface of the skirt, and said legs are situated axisymmetrically opposite each other.

2. A cup tappet of claim 1, wherein the support for the gas exchange valve is configured as one of a frustoconical elevation or a reniform elevation on the web.

3. A cup tappet of claim 2, wherein the support is generated by a non-chipping fabrication method.

4. A cup tappet of claim 3, wherein the non-chipping fabrication method is stamping.

5. A cup tappet of claim 1, wherein the support for the gas exchange valve is configured as a dish-like cavity in the web.

6. A cup tappet of claim 5, wherein the support is generated by a non-chipping fabrication method.

7. A cup tappet of claim 6, wherein the non-chipping fabrication method is stamping.

8. A cup tappet of claim 1, wherein the entire inner end surface of the bottom together with the web is made by a non-chipping fabrication method which is one of stamping or extrusion.

9. A cup tappet of claim 1, wherein the roof-like sloping legs are made as thin-walled ribs that are spaced from the inner end surface of the bottom.

10. A cup tappet of claim 1, wherein the roof-like sloping legs have one of a substantially convex or a substantially concave shape.

11. A cup tappet of claim 1, wherein the roof-like sloping legs are substantially flat.

12. A cup tappet of a valve train of an internal combustion engine, said cup tappet comprising a hollow cylindrical skirt closed at one end by a bottom, said bottom comprising an outer end surface and an inner end surface, said outer end surface comprising a contact surface for a cam and said inner end surface comprising a central support for a gas exchange valve, wherein the inner end surface of the bottom comprises a radially extending flat web, the support is arranged symmetrically between edges of the web, a roof-like sloping leg extends from each edge away from the bottom up to an inner surface of the skirt, and said legs are situated axisymmetrically opposite each other, wherein the cup tappet comprises a means for preventing rotation of the cup tappet relative to a surrounding structure, and the outer end surface of the bottom has a cylindrical shape as viewed in a cam excursion direction (A).

13. A cup tappet of claim 12, wherein the web on the inner end surface of the bottom extends orthogonally to the cylindrical shape of the outer end surface of the bottom.

14. A cup tappet of claim 12, wherein the means for preventing rotation is a body that is fixed in a recess of the skirt and projects at least radially outwards beyond the skirt, said body being one of a needle roller, a pin or a pin-like element.

* * * * *